US007119055B2

(12) United States Patent
Cheung et al.

(10) Patent No.: US 7,119,055 B2
(45) Date of Patent: Oct. 10, 2006

(54) HARD SURFACE CLEANERS COMPRISING A THICKENING GUM MIXTURE

(75) Inventors: Tak Wai Cheung, Bridgewater, NJ (US); Pamela A. Boone, Montvale, NJ (US); Delford I. Christmas, Montvale, NJ (US); Lisa A. Napolitano, Bergenfield, NJ (US); Benjamin Costa, Nutley, NJ (US); Virginia L. Urban, Montvale, NJ (US)

(73) Assignee: Reckitt Benckiser Inc., Parsippany, NJ (US)

( * ) Notice: Subject to any disclaimer, the term of this patent is extended or adjusted under 35 U.S.C. 154(b) by 74 days.

(21) Appl. No.: 10/789,075

(22) Filed: Feb. 27, 2004

(65) Prior Publication Data

US 2005/0020471 A1 Jan. 27, 2005

Related U.S. Application Data

(63) Continuation-in-part of application No. PCT/GB02/03407, filed on Jul. 25, 2002, and a continuation-in-part of application No. PCT/GB04/000589, filed on Feb. 17, 2004.

(30) Foreign Application Priority Data

Aug. 31, 2001 (GB) ..... 0121111.9
Feb. 22, 2003 (GB) ..... 0304088.8

(51) Int. Cl.
*C11D 1/83* (2006.01)
*C11D 9/20* (2006.01)

(52) U.S. Cl. ..... 510/418; 510/235; 510/236; 510/238; 510/253; 510/268; 510/269; 510/368; 510/426

(58) Field of Classification Search ..... 510/235, 510/236, 238, 253, 268, 269, 368, 418, 426
See application file for complete search history.

(56) References Cited

U.S. PATENT DOCUMENTS

| | | | | |
|---|---|---|---|---|
| 2,974,134 | A | 3/1961 | Pollitzer | |
| 3,219,656 | A | 11/1965 | Boettner | |
| 3,598,865 | A | 8/1971 | Lew | |
| 3,640,998 | A | 2/1972 | Mansfield et al. | |
| 3,707,535 | A | 12/1972 | Lew | |
| 3,772,269 | A | 11/1973 | Lew | |
| 3,839,318 | A | 10/1974 | Mansfield | |
| 3,974,138 | A | 8/1976 | Lew | |
| 4,129,423 | A * | 12/1978 | Rubin | 510/398 |
| 4,223,129 | A | 9/1980 | Roth et al. | |
| 4,528,106 | A | 7/1985 | Grolitzer | |
| 4,759,867 | A | 7/1988 | Choy et al. | |
| 4,861,511 | A | 8/1989 | Kaplan | |
| 4,891,148 | A | 1/1990 | Ouhadi et al. | |
| 5,008,030 | A | 4/1991 | Cook et al. | |
| 5,039,441 | A | 8/1991 | Thomas et al. | |
| 5,061,393 | A | 10/1991 | Linares et al. | |
| 5,192,460 | A | 3/1993 | Thomas et al. | |
| 5,256,328 | A | 10/1993 | Cavanaugh et al. | |
| 5,562,850 | A | 10/1996 | Woo et al. | |
| 5,601,749 | A * | 2/1997 | Hall et al. | 510/336 |
| 5,648,328 | A | 7/1997 | Angell et al. | |
| 5,872,088 | A * | 2/1999 | Pucci et al. | 510/238 |
| 5,945,390 | A | 8/1999 | Veltman et al. | |
| 5,990,061 | A | 11/1999 | Veltman et al. | |
| 6,001,789 | A | 12/1999 | Trinh et al. | |
| 6,008,172 | A | 12/1999 | Broshi et al. | |
| 6,037,316 | A * | 3/2000 | Garner et al. | 510/238 |
| 6,083,890 | A | 7/2000 | Miskiel et al. | |
| 6,197,738 | B1 | 3/2001 | Regutti | |
| 6,235,127 | B1 | 5/2001 | Rader et al. | |
| 6,258,771 | B1 * | 7/2001 | Hsu et al. | 510/418 |
| 6,294,186 | B1 * | 9/2001 | Beerse et al. | 424/405 |
| 6,339,058 | B1 | 1/2002 | Toussaint et al. | |
| 6,380,150 | B1 | 4/2002 | Toussaint et al. | |
| 6,440,915 | B1 | 8/2002 | Rader et al. | |
| 6,467,699 | B1 | 10/2002 | Vorlop et al. | |
| 6,627,590 | B1 * | 9/2003 | Sherry et al. | 510/238 |
| 6,689,223 | B1 * | 2/2004 | Meine et al. | 134/2 |
| 6,767,880 | B1 | 7/2004 | Foley et al. | |
| 6,855,681 | B1 | 2/2005 | Ness et al. | |
| 2002/0183216 | A1 | 12/2002 | Koening et al. | |
| 2003/0092595 | A1 | 5/2003 | Romero et al. | |
| 2004/0018950 | A1 | 1/2004 | Foley et al. | |
| 2004/0033912 | A1 | 2/2004 | Sakurai et al. | |
| 2004/0171508 | A1 | 9/2004 | Fregonese | |
| 2004/0186037 | A1 | 9/2004 | Cheung et al. | |
| 2005/0020471 | A1 | 1/2005 | Cheung et al. | |
| 2005/0026801 | A1 | 2/2005 | Broeckx et al. | |
| 2005/0026802 | A1 | 2/2005 | Kilkenny et al. | |
| 2005/0043200 | A1 | 2/2005 | Barry et al. | |

FOREIGN PATENT DOCUMENTS

| | | |
|---|---|---|
| EP | 0216416 A2 | 4/1987 |
| EP | 0240481 A1 | 7/1987 |
| EP | 0292910 A2 | 11/1988 |
| EP | 0919610 A1 | 10/1997 |
| EP | 0957156 A1 | 5/1998 |

(Continued)

OTHER PUBLICATIONS

PCT International Search Report for PCT/GB02/03407 dated Oct. 14, 2002.
GB Search Report for GB 0211111.9 dated Feb. 20, 2002.

*Primary Examiner*—Charles Boyer
(74) *Attorney, Agent, or Firm*—Norris McLaughlin & Marcus PA

(57) ABSTRACT

The present invention is directed to a sprayable, acidic hard surface cleaning and/or disinfecting composition which contains suspended inclusions which appear as visibly discernible, discrete particulate materials, preferably where said discrete particulate materials are based on alginates.

22 Claims, No Drawings

FOREIGN PATENT DOCUMENTS

| | | | |
|---|---|---|---|
| EP | 1 010 751 | A | 6/2000 |
| GB | 763547 | | 11/1953 |
| GB | 790306 | | 2/1958 |
| GB | 2 066 660 | | 12/1980 |
| GB | 2179055 | A | 2/1987 |
| GB | 2288186 | A | 10/1995 |
| GB | 2341870 | | 3/2000 |
| WO | WO 97/02125 | | 1/1997 |
| WO | WO 97/15649 | | 5/1997 |
| WO | WO 99/35227 | | 7/1999 |
| WO | WO 00/17303 | | 3/2000 |
| WO | WO 01/00765 | A1 | 1/2001 |
| WO | WO 01/57174 | A1 | 8/2001 |
| WO | 01/77278 | * | 10/2001 |
| WO | WO 01/77278 | A | 10/2001 |
| WO | WO 03/020863 | A | 3/2003 |

* cited by examiner

HARD SURFACE CLEANERS COMPRISING A THICKENING GUM MIXTURE

The present application is a continuation in part application filed under 35 USC 111 (a) of International Applications PCT/GB02/03407 filed Jul. 25, 2002 and PCT/GB04/000589 filed Feb. 17, 2004.

The present invention relates to sprayable disinfecting hard surface cleaning compositions. More particularly the present invention relates to thickened lavatory cleaning compositions which provide a cleaning and disinfecting effect to hard surfaces, and which include visibly discernible inclusions.

Cleaning compositions which also provide a disinfecting or sanitizing effect are commercially important products. Such compositions enjoy a wide field of utility in assisting in the removal of stains and grime from surfaces, especially those characterized as useful with "hard surfaces". Hard surfaces are those which are frequently encountered in lavatories such as lavatory fixtures such as toilets, shower stalls, bathtubs, bidets, sinks, etc., as well as countertops, walls, floors, etc. Two types of commonly encountered stains in lavatories include "hard water" stains and "soap scum" stains. Such hard surfaces, and such stains, may also be found in different environments as well, including kitchens, hospitals, etc.

Various formulations in compositions of cleaning agents have been produced and are known to the art which cleaning agents are generally suited for one type of stain but not necessarily for both classes of stains. For example, it is known to the art that highly acidic cleaning agents comprising strong acids, such as hydrochloric acids, are useful in the removal of hard water stains. However, the presence of strong acids is known to be an irritant to the skin and further offers the potential of toxicological danger. Other classes of cleaning compositions and formulations are known to be useful upon soap scum stains, however, generally such compositions comprise an organic and/or inorganic acid, one or more synthetic detergents from commonly recognized classes such as those described in U.S. Pat. No. 5,061,393; U.S. Pat. No. 5,008,030; U.S. Pat. No. 4,759,867; U.S. Pat. No. 5,192,460; U.S. Pat. No. 5,039,441. Generally, the compositions described in these patents are claimed to be effective in the removal of soap scum stains from such hard surfaces and may find further limited use in other classes of stains.

However, the formulations of most of the compositions within the aforementioned patents generally have relatively high amounts of acids (organic and/or inorganic) which raises toxicological concerns, and further none of the above patents provide any disinfecting properties.

While many disinfecting hard surface cleaning compositions are known to the art, there is nonetheless a need for further improved compositions in the art.

According to a further aspect of the invention, there is provided a sprayable hard surface cleaning and/or disinfecting composition which comprises (preferably consists essentially of):

a thickener constituent which comprises both gellan gum and xanthan gum;

at least one nonionic surfactant;

an acid constituent;

suspended inclusions which appear as visibly discernible, discrete particulate materials, preferably where said discrete particulate materials are based on alginates;

optionally, at least one further detersive surfactant selected from amphoteric and zwitterionic surfactants;

optinally at least one anionic surfactant;

optionally, but in certain cases desirably at least one organic solvent;

optionally, one or more constituents for improving the aesthetic or functional features of the inventive compositions; and;

water.

According to a further aspect of the invention there is provided a sprayable hard surface cleaning and/or disinfecting composition which comprises (preferably consists essentially of):

a thickener constituent which comprises both gellan gum and xanthan gum;

at least one anionic surfactant;

at least one nonionic surfactant;

an acid constituent;

suspended inclusions present as two or more classes of visibly discernible, discrete particulate materials, preferably where said discrete particulate materials are based on alginates;

optionally, but in certain cases desirably at least one organic solvent;

optionally, at least one further detersive surfactant selected from amphoteric and zwitterionic surfactants;

optionally, one or more constituents for improving the aesthetic or functional features of the inventive compositions; and;

water.

In further aspects of the invention there are provided processes for the production of the aforesaid compositions.

It is yet a further object of the invention to provide a readily sprayable cleaning composition which features the benefits described above.

It is a further object of the invention to provide a process for the improvement of the simultaneous cleaning and sanitization of hard surfaces, which process comprises the step of: providing a composition as outlined above, and applying an effective amount to a hard surface requiring such treatment.

Particularly preferred compositions according to the invention are acidic in character, are effective in the removal of both soap scum stains and hard water stains, and which compositions provide an effective sanitizing effect to hard surfaces. Further, particularly preferred sprayable compositions may be dispensed from a manually operable trigger pump spray apparatus and the composition provided by such device has visibly discernible, visibly discrete particulate materials on a treated hard surface.

The inventive compositions necessarily comprise a thickener constituent. In addition to the gellan gum and the xanthan gum, one or more further thickeners may also be included in the inventive compositions. By way of non-limiting example such further thickeners include one or more of: cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, and mixtures thereof. Examples of the cellulose derivatives include ethyl cellulose, hydroxy ethyl cellulose, hydroxy propyl cellulose, carboxy methyl cellulose, carboxy methyl hydroxyethyl cellulose, hydroxypropyl cellulose, hydroxy propyl methyl cellulose, and ethyl hydroxy ethyl cellulose. Preferably, the thickener constituent is a mixture of xanthan gum and gellan gum to the exclusion of other thickener constituents described herein. Further examples of preferred thickener constituents are described in the Examples.

The gellan gum and the xanthan gum may be present in the thickener constituent in any relative amounts with respect to each other. Desirably however the ratio of gellan gum to xanthan gum on a respective parts by weight basis is from 1:1–10, preferably 1:1–5 but more preferably from 1:1 to 1:2 parts by weight. These preferred respective weight ratios may be used in the presence of further thickeners forming the thickener constituent, and especially preferably are used in the absence of further thickeners. The present inventors have observed that the combination of gellan gum and xanthan gum, especially in the respective weight ratios described above are particularly effective in providing the desirable rheological properties to the sprayable compositions. Even minor amounts of gellan gum when combined with xanthan gum may provide surprisingly good thickening and desirable rheological properties.

The amount of thickener present in the composition may be any amount which is effective in suspending the suspended inclusions as hereinafter described. Desirably the composition of the present of invention is thickened to a viscosity range of from about 25 to about 350 centipoise, preferably to a viscosity of from about 100 to about 300 centipoise, more preferably is in the range of about 50–200 centipoise measured at room temperature, on a LVTDV IIBrookfield viscometer, spindle #1, at 30 rpm, measured at 25° C. Generally good thickening has been observed when the total amount of the thickeners are present in amount from about 0.001 to about 5% by weight, more preferably from about 0.001 to about 3% by weight, more preferably from about 0.001–1.5% wt, still more preferably from about 0.01–0.50% wt. and most preferably the total amount of the thickeners are present in the inventive compositions in amount of from about 0.03% wt. to about 0.20% wt.

Preferably other thickening materials known to the art, particularly those based on synthetic polymers such as acrylic acid copolymers, e.g. Carbopol® materials, as well as those based on clays are desirably absent from the inventive compositions.

The inventive compositions further requires at least one nonionic surfactant. Generally any nonionic surfactant material may be used in the inventive compositions. Practically any hydrophobic compound having a carboxy, hydroxy, amido, or amino group with a free hydrogen attached to the nitrogen can be condensed with an alkylene oxide, especially ethylene oxide or with the polyhydration product thereof, a polyalkylene glycol, especially polyethylene glycol, to form a water soluble or water dispersible nonionic surfactant compound. By way of non-limiting example, particularly examples of suitable nonionic surfactants which may be used in the present invention include the following:

One class of useful nonionic surfactants include polyalkylene oxide condensates of alkyl phenols. These compounds include the condensation products of alkyl phenols having an alkyl group containing from about 6 to 12 carbon atoms in either a straight chain or branched chain configuration with an alkylene oxide, especially an ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

A further class of useful nonionic surfactants include the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those C6–11 straight-chain alcohols which are ethoxylated with from about 3 to about 6 moles of ethylene oxide. Their derivation is well known in the art. Examples include Alfonic® 810-4.5, which is described in product literature from Sasol as a C8–10 having an average molecular weight of 356, an ethylene oxide content of about 4.85 moles (about 60 wt. %), and an HLB of about 12; Alfonic® 810-2, which is described in product literature as a C8–C10 having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are C10 oxo-alcohol ethoxylates available from BASF under the Lutensol® ON tradename. They are available in grades containing from about 3 to about 11 moles of ethylene oxide (available under the names Lutensolg ON 30; Lutensol® ON 50; Lutensol® ON 60; Lutensol® ON 65; Lutensol® ON 66; Lutensol® ON 70; Lutensol® ON 80; and Lutensol®ON 110). Other examples of ethoxylated alcohols include the Neodol® 91 series non-ionic surfactants available from Shell Chemical Company which are described as C9–11 ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula RO(CH2CH2O)nH where R is the primary linear alcohol and n is the total number of moles of ethylene oxide. The ethoxylated alcohol series from Tomah include 91-2.5; 91-6; 91-8— where R is linear C9/C10/C11 and n is 2.5, 6, or 8; 1-3; 1-5; 1-7; 1-73B; 1-9; where R is linear C11 and n is 3, 5, 7 or 9; 23-1; 23-3; 23-5; 23-6.5— where R is linear C12/C13 and n is 1, 3, 5, or 6.5; 25-3; 25-7; 25-9; 25-12— where R is linear C12/C13/C14/C15 and n is 3, 7, 9, or 12; and 45-7; 45-13— where R is linear C14/C15 and n is 7 or 13.

A further class of useful nonionic surfactants include primary and secondary linear and branched alcohol ethoxylates, such as those based on C6–C18 alcohols which further include an average of from 2 to 80 moles of ethoxylation per mol of alcohol. These examples include the Genapol® UD (ex. Clariant, Muttenz, Switzerland) described under the tradenames Genapol® UD 030, C11-oxo-alcohol polyglycol ether with 3 EO; Genapol® UD, 050 C11-oxo-alcohol polyglycol ether with 5 EO; Genapol® UD 070, C11-oxo-alcohol polyglycol ether with 7 EO; Genapol® UD 080, Cl 1-oxo-alcohol polyglycol ether with 8 EO; Genapol® UD 088, C11-oxo-alcohol polyglycol ether with 8 EO; and Genapol® UD 110, C11-oxo-alcohol polyglycol ether with 11 EO.

A further class of useful nonionic surfactants include those surfactants having a formula RO(CH2CH2O)nH wherein R is a mixture of linear, even carbon-number hydrocarbon chains ranging from C12H25 to C16H33 and n represents the number of repeating units and is a number of from about 1 to about 12. Surfactants of this formula are presently marketed under the Genapol® tradename (ex. Clariant), which surfactants include the "26-L" series of the general formula RO(CH2CH2O)nH wherein R is a mixture of linear, even carbon-number hydrocarbon chains ranging from C12H25 to C16H33 and n represents the number of repeating units and is a number of from 1 to about 12, such as 26-L-1,26-L-1.6, 26-L-2,26-L-3,26-L-5,26-L-45, 26-L-50, 26-L-60, 26-L-60N, 26-L-75, 26-L-80, 26-L-98N, and the 24-L series, derived from synthetic sources and typically contain about 55% C12 and 45% C14 alcohols, such as 24-L-3, 24-L-45, 24-L-50, 24-L-60, 24-L-60N, 24-L-75, 24-L-92, and 24-L-98N, all sold under the Genapol® tradename.

A further class of useful nonionic surfactants include alkoxy block copolymers, and in particular, compounds based on ethoxy/propoxy block copolymers. Polymeric alkylene oxide block copolymers include nonionic surfactants in which the major portion of the molecule is made up of block polymeric C2–C4 alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO\text{-}(EO)_x(PO)_y(EO)_z\text{—}H \quad (A)$$

where

EO represents ethylene oxide,

PO represents propylene oxide, y equals at least 15, (EO)x+y equals 20 to 50% of the total weight of said compounds, and, the total molecular weight is preferably in the range of about 2000 to 15,000. These surfactants are available under the PLURONIC®(ex. BASF) or EMULGEN® (ex. Kao.)

A further group of such useful nonionic surfactants containing the characteristic alkylene oxide blocks are those can be represented by the formula (B):

$$R\text{-}(EO,PO)_a(EO,PO)_b\text{—}H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block. Specific nonionic surfactants which in general are encompassed by Formula B include butoxy derivatives of propylene oxide/ethylene oxide block polymers having molecular weights within the range of about 2000–5000.

Still further examples of useful nonionic surfactants include those which can be represented by formula (C) as follows:

$$RO\text{-}(BO)_n(EO)_x\text{—}H \quad (C)$$

wherein

EO represents ethylene oxide,

BO represents butylene oxide,

R is an alkyl group containing I to 20 carbon atoms, n is about 5–15 and x is about 5–15.

Yet further useful nonionic surfactants include those which may be represented by the following formula (D):

$$HO\text{-}(EO)_x(BO)_n(EO)_y\text{—}H \quad (D)$$

wherein

EO represents ethylene oxide,

BO represents butylene oxide, n is about 5–15, preferably about 15, x is about 5–15, preferably about 15, and y is about 5–15, preferably about 15.

Still further exemplary useful nonionic block copolymer surfactants include ethoxylated derivatives of propoxylated ethylene diamine, which may be represented by the following formula:

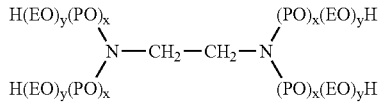

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Particularly preferred nonionic block copolymers include those based on a polymeric ethoxy/propoxy units which may also be used include those presently commercially available in the PLURAFACS series of block copolymers (ex. BASF) These are described to be nonionic surfactants based on ethoxy/propoxy block copolymers, conveniently available in a liquid form from its supplier. One particularly preferred nonionic block copolymer is PLURAFAC® SL-62 which is described to be a nonionic surfactant based on ethoxy/propoxy block copolymers having an average of from about 1–3 moles propoxy groups, and 4–12 moles ethoxy groups and having a total molecular weight from about 600–650. In certain preferred embodiments of the inventive composition present the sole nonionic surfactant present is a nonionic surfactant based on ethoxy/propoxy units, and especially is a nonionic block copolymer as described with reference to PLURAFAC® SL-62.

Further useful non-ionic surfactants which may be used in the inventive compositions include those presently marketed under the trade name Pluronics® (ex. BASF). The compounds are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyoxyethylene radicals of the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants are in liquid form and particularly satisfactory surfactants are available as those marketed as Pluronics® L62 and Pluronics® L64. Alkylmonoglyocosides and alkylpolyglycosides which find use in the present inventive compositions include known nonionic surfactants which are alkaline and electrolyte stable. Alkylmonoglycosides and alkylpolyglycosides are prepared generally by reacting a monosaccharide, or a compound hydrolyzable to a monosaccharide with an alcohol such as a fatty alcohol in an acid medium. Various glycoside and polyglycoside compounds including alkoxylated glycosides and processes for making them are disclosed in U.S. Pat. Nos. 2,974,134; 3,219,656; 3,598,865; 3,640,998; 3,707,535, 3,772,269; 3,839,318; 3,974,138; 4,223,129 and 4,528,106 the contents of which are incorporated by reference.

One exemplary group of such useful alkylpolyglycosides include those according to the formula:

$$RO\text{-}(C_nH_{2n}O)_r\text{-}(Z)_x$$

wherein:

R is a hydrophobic group selected from alkyl groups, alkylphenyl groups, hydroxyalkylphenyl groups as well as mixtures thereof, wherein the alkyl groups may be straight chained or branched, and which contain from about 8 to about 18 carbon atoms, n has a value of 2–8, especially a value of 2 or 3;

r is an integer from 0 to 10, but is preferably 0,

Z is derived from glucose; and, x is a value from about 1 to 8, preferably from about 1.5 to 5.

Preferably the alkylpolyglycosides are nonionic fatty alkylpolyglucosides which contain a straight chain or branched chain C8–C15 alkyl group, and have an average of from about 1 to 5 glucose units per fatty alkylpolyglucoside molecule. More preferably, the nonionic fatty alkylpolyglucosides which contain straight chain or branched C8–C15 alkyl group, and have an average of from about 1 to about 2 glucose units per fatty alkylpolyglucoside molecule.

A further exemplary group of alkyl glycoside surfactants suitable for use in the practice of this invention may be presented by the following formula (A):

$$RO\text{-}(R^1O)y\text{-}(G)xZb \qquad (A)$$

wherein:

R is a monovalent organic radical containing from about 6 to about 30, preferably from about 8 to 18 carbon atoms, $R^1$ is a divalent hydrocarbon radical containing from about 2 to about 4 carbon atoms, y is a number which has an average value from about 0 to about 1 and is preferably 0, G is a moiety derived from a reducing saccharide containing 5 or 6 carbon atoms; and, x is a number having an average value from about 1 to 5 (preferably from 1.1 to 2);

Z is $O_2M^1$,

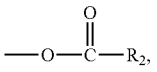

$O(CH_2)$, $CO_2M^1$, $OSO_3M^1$, or $O(CH_2)SO_3M^1$; $R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $CH_2OH$, is oxidized to form a

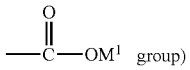

b is a number of from 0 to 3x+1 preferably an average of from 0.5 to 2 per glycosal group;

p is 1 to 10, $M^1$ is $H^+$ or an organic or inorganic counterion, particularly cations such as, for example, an alkali metal cation, ammonium cation, monoethanolamine cation or calcium cation. As defined in Formula (A) above, R is generally the residue of a fatty alcohol having from about 8 to 30 and preferably 8 to 18 carbon atoms. Examples of such alkylglycosides as described above include, for example APG 325 CS Glycoside® which is described as being a 50% $C_9$–$C_{11}$ alkyl polyglycoside, also commonly referred to as D-glucopyranoside, (commercially available from Henkel KGaA) and Glucopon® 625 CS which is described as being a 50% $C_{10}$–$C_{16}$ alkyl polyglycoside, also commonly referred to as a D-glucopyranoside, (ex. Henkel).

Further nonionic surfactants which may be included in the inventive compositions include alkoxylated alkanolamides, preferably $C_8$–$C_{24}$ alkyl di(C2–C3 alkanol amides), as represented by the following formula:

$$R^5\text{—}CO\text{—}NH\text{—}R^6\text{—}OH$$

wherein $R^5$ is a branched or straight chain $C_8$–$C_{24}$ alkyl radical, preferably a $C_{10}$–$C_{16}$ alkyl radical and more preferably a $C_{12}$–$C_{14}$ alkyl radical, and $R^6$ is a $C_1$–$C_4$ alkyl radical, preferably an ethyl radical.

The inventive compositions may also include a nonionic amine oxide constituent. Exemplary amine oxides include:

(A) Alkyl di (lower alkyl) amine oxides in which the alkyl group has about 10–20, and preferably 12–16 carbon atoms, and can be straight or branched chain, saturated or unsaturated. The lower alkyl groups include between 1 and 7 carbon atoms. Examples include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

(B) Alkyl di (hydroxy lower alkyl) amine oxides in which the alkyl group has about 10–20, and preferably 12–16 carbon atoms, and can be straight or branched chain, saturated or unsaturated. Examples are bis(2-hydroxyethyl) cocoamine oxide, bis(2-hydroxyethyl) tallowamine oxide; and bis(2-hydroxyethyl) stearylamine oxide;

(C) Alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide; and (D) Alkylmorpholine oxides in which the alkyl group has about 10–20, and preferably 12–16 carbon atoms, and can be straight or branched chain, saturated or unsaturated.

Preferably the amine oxide constituent is an alkyl di (lower alkyl) amine oxide as denoted above and which may be represented by the following structure:

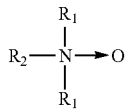

wherein each:

$R_1$ is a straight chained $C_1$–$C_4$ alkyl group, preferably both $R_1$ are methyl groups; and, $R_2$ is a straight chained $C_8$–$C_{18}$ alkyl group, preferably is $C_{10}$–$C_{14}$ alkyl group, most preferably is a $C_{12}$ alkyl group.

Each of the alkyl groups may be linear or branched, but most preferably are linear. Most preferably the amine oxide constituent is lauryl dimethyl amine oxide. Technical grade mixtures of two or more amine oxides may be used, wherein amine oxides of varying chains of the $R_2$ group are present. Preferably, the amine oxides used in the present invention include $R_2$ groups which comprise at least 50% wt., preferably at least 60% wt. of $C_{12}$ alkyl groups and at least 25% wt. of $C_{14}$ alkyl groups, with not more than 15% wt. of $C_{16}$, $C_{18}$ or higher alkyl groups as the $R_2$ group.

Of course the nonionic surfactant constituent, when present, my comprise two or more nonionic surfactants. The nonionic surfactant is present in the compositions of the present invention in an amount of from about 0.1 to about 10% by weight, more preferably is present in an amount of from about 0.1–5% wt., yet more preferably in an amount of from about 0.25–2% wt., and most preferably in an amount of from about 0.3–1.5% wt.

The present inventive compositions necessarily comprise an acid constituent which be a water soluble inorganic acid, or a water soluble organic acids. By way of non-limiting example useful inorganic acids include hydrochloric acid, phosphonic, and sulfuric acid. With respect to water soluble organic acids, generally include at least one carbon atom, and include at least one carboxyl group (—COOH) in its structure. Preferred are water soluble organic acids which contain from 1 to about 6 carbon atoms, and at least one carboxyl group as noted. Particularly preferred amongst such organic acids are: formic acid, citric acid, sorbic acid, acetic acid, boric acid, maleic acid, adipic acid, lactic acid, malic acid, malonic acid, glycolic acid, and mixtures thereof. According to certain preferred embodiments however, the acid constituent is a combination of citric acid in combination with at least one further acid selected from the group consisting of sorbic acid, acetic acid, boric acid, formic acid, maleic acid, adipic acid, lactic acid, malic acid, malonic acid, and glycolic acid. Most preferably, the acid constituent is a combination of citric acid with lactic acid, glycolic acid or malic acid.

As the inventive compositions are necessarily acidic in nature (pH<7.0) there should be sufficient acid present in the composition such that the pH of the composition is desirably less than 6, preferably from about 2 to about 3.5, more preferably from about 2.8 to about 3.3, and most preferably from about 3.0 to about 3.3. Of course mixtures of two or more acids may be used, and the acid constituent may be present in any effective amount. Desirably however, the acid constituents is present in an amount not in excess of 10% wt. based on the total weight of the compositions; preferably the acid constituent is present in an amount of from about 0.05–8% wt., more preferably from about 1–6% wt., and most preferably is present in an amount of from about 2% wt. to about 5% wt. The acid constituent of the inventive formulations provide free acidity within the cleaning composition, which free acid reacts with the fatty acid metal salts which are comprised within soap scum stains releasing the metal ions and freeing the fatty acid, which facilitates the removal of these undesired stains from hard surfaces. These acids also sequester the resulting free metal ions which are released from the soap scum stains. Also where the acids are selected to feature disinfecting properties, they concomitantly provide anti-microbial activity necessary to disinfect the cleaned surface.

As a necessary constituent, the inventive compositions include suspended inclusions. These suspended inclusions appear as visibly discernible, discrete particulate materials to the consumer of the inventive compositions. These suspended inclusions desirably appear as small discrete visible particles suspended within the composition, particularly by a consumer having normal "20/20" vision. It is to be understood however that not all of the particulate materials present in the inventive composition need be visibly discernible as a portion of the particulate materials may be smaller than the visible threshold of the consumer having normal vision. It is nonetheless required that at least a portion of the particulate materials present in the inventive composition need be visibly discernible as discrete particles.

Desirably the suspended inclusions are alginate based particulate materials which are supplied to have an average particle size in the range of about 50 μm to about 1000 μm, preferably in the range of about 350 μm to about 700 μm, most preferably in the range of about 550 μm to about 650 μm, and especially preferably in the range of about 5751 μm to about 625 μm. Desirably the average particle size of these particulate materials represents that at least 85% of the particles, more preferably at least 90%, still more preferably at least 92%, and most preferably at least 95% of the particles present are within a specified range.

While the suspended inclusions present in the inventive compositions are most desirably based on alginates although other visibly discernible, discrete particulate materials may be used as well, or in the place of alginate based materials.

Alginate based particulate materials particularly useful for the suspended inclusions in the inventive compositions may be formed from an alginate or salts of alginic acid such as potassium alginate, calcium alginate or sodium alginate salts, and advantageously may be conveniently harvested from naturally occurring seaweed especially of the species *Laminaria* wherein the sodium alginate form predominates. Alginates typically consist of sequences of α-L-guluronic acid and β-D-mannuronic acid which may be present in the alginate in various differing ratios. The term "beads" conveniently describes the geometry of the alginate based particulate materials as when these are formed form an aqueous slurry containing an alginate such as sodium alginate with one or more further constituents and then expelled to form individual particles or droplets, the coalescing aqueous slurry may form generally spherical particles, hence the term "beads". Of course, other processes for the formation of alginate based suspended inclusions are also contemplated as being useful in conjunction with the present invention such as processes wherein the alginate optionally containing one or more further constituents is comminuted by other methods, such as milling, grinding or other known art technique. In such instances the comminuted alginate based suspended inclusions may not necessarily form generally spherical particles but may form individual particles of irregular geometry. In such an instance the largest dimension of such individual particles of irregular geometry are used as the basis for determining the average particle size of the The alginate based particulate materials may contain from about 0.5% wt. to 100% wt. of an alginate or alginate salt, although quite frequently the amount of alginate in the alginate based particulate materials are much less, generally on from about 0.5% wt. to about 110% wt., more preferably from about 0.5% wt. to about 5% wt. Such alginate based particulate materials may be conveniently referred to as "alginate beads". Such alginate beads may be formed by a variety of known art processes including those described in the background section of PCT/US95/08313 to Thomas et al., as well as in U.S. Pat. No. 6,467,699 B 1, the contents of which are incorporated by reference. Alternately such alginate based particulate materials may be commercially purchased from various suppliers, including geniaLab Bio-Technologie (Braunschwig, Germany). As noted the composition of the alginate based particulate materials may include only a small proportion of an alginate or alginate salt, and may include one or more further non-alginate materials especially one or more inorganic materials such as titanium dioxide which improves the opacity, hence the visibility of the beads, as well as one or more coloring agents such as pigments such as ultramarine blue, said coloring agents which also improve the aesthetic appearance of the beads. Other further non-alginate materials not recited herein may also be include in the composition of the alginate based particulate materials. The alginate based particulate materials may be composed of a major proportion of water which is entrained within the structure of the discrete alginate based particulates and due to the highly porous character of alginates when in an aqueous compositions 80% wt., and usually 90% wt. or even greater of the mass of the discrete alginate based particulates may be water with the remaining balance to 100% wt. being the alginate or alginate salt, and one or more further non-alginate materials. Conveniently such alginate based particulate materials may be prepared, stored and sold as a slurry of discrete alginate based particulates in an aqueous-based carrier composition which may contain a minor amount of one or more further additives such as one or more salts especially chloride salts such as calcium chloride, as well as a preservative for inhibiting the growth of undesirable microorganisms in the slurry containing the discrete alginate based particulates. A preferred commercially available alginate based particulate material comprise from about 0.5% wt. to about 5% wt. of a calcium alginate, a pigment present in an amount up to about 0.01% wt., from about 0.1% wt. to about 5% wt. of TiO2 and the remaining balance of the mass of the alginate based particulate material comprised of a 2% calcium chloride solution in water which may also con an a minor amount, approx. 2% of calcium chloride. Such an alginate based particulate material can be separated from its aqueous-based carrier composition by means of a fine sieve or other means for decanting the aqueous-based carrier composition from the alginate based particulate materials.

According to certain particularly preferred aspects of the invention, the inventive compositions comprise two or more classes of visibly discernible, discrete particulate materials present as suspended inclusions. What is to be understood by the term "class" is a group of visibly discernible, discrete particulate materials present as suspended inclusions which present a characteristic visual appearance to the consumer of the product made of a plurality of individual particles which are indistinguishable from one another. Examples of characteristic visual appearances include, e.g., color, size, translucency or opacity, as well as average size and geometrical shape of the individual particles. Examples of two or more classes of visibly discernible, discrete particulate materials present as suspended inclusions in preferred embodiments of the invention include by way of non-limiting example: visibly discernible, discrete particulate materials of two or more different colors; visibly discernible, discrete particulate materials of two or more different sizes; visibly discernible, discrete particulate materials of different degrees of translucency or opacity; as well as visibly discernible, discrete particles of two or more distinguishable particle shapes or geometries. Of course, the two or more classes of visibly discernible discrete particulate materials present as suspended inclusions in certain preferred embodiments of the invention may be various combinations of the above exemplary visually distinguishable types, including: compositions comprising visibly discernible, discrete particulate materials of two, three, four or more different colors wherein the discrete particulate materials otherwise have essentially the same particle size and particle shapes. Alternately preferred as the two or more classes of visibly discernible discrete particulate materials present in the compositions include visibly discernible, discrete particulate materials of two, three, four or more different colors wherein the discrete particulate materials otherwise have different particle sizes and/or different particle shapes irregardless of the colors of the particulate materials. In a still further preferred embodiment the two or more classes of visibly discernible discrete particulate materials present in the compositions include visibly discernible, discrete particulate materials of two or more classes, wherein each class of particulate materials are of one average particle size or particle shape, yet wherein the average particle size or particle shape of the particulate materials of each class is different from one class to the other.

The selection of the appearance characteristics two or more classes of visibly discernible, discrete particulate materials present as suspended inclusions may be desired from a consumer standpoint particularly to enhance the appearance of a product composition. The inclusion of two, but especially three or more classes of colored particulate materials each class being of a different contrasting color is particularly advantageous as providing an attractive appearance. Alternately the inclusion of two, but especially three or more classes of colored particulate materials each class being of a different contrasting color and also wherein average particle size of at least two classes of colored particulate materials are different is also particularly advantageous as providing an attractive appearance as well.

By the term "suspended" when referring to inclusions is to be understood that when the formed inventive compositions are manually shaken and then allowed to return to a quiescent state, such as by permitting them to stand on a tabletop or other surface at room temperature (approx. 20° C.) for 48 hours, the majority of the inclusions do not drop more than 7%, preferably do not drop more than 5%, most preferably do not drop more than 2% of their original distance from the bottom of the container in which the inventive composition is present when they have returned to a quiescent state following manual shaking. By "majority of inclusions" is meant to convey that at least 90% of, preferably at least 95% and most preferably at least 97% of the inclusions physically present in the compositions. This is a particularly attractive and characteristic feature of preferred embodiments of inventive compositions, as the suspended inclusions do not appear to move perceptibly over long periods of time. Desirably, at least 90% of, preferably at least 95% and most preferably at least 97% of the inclusions physically present in the compositions do not drop more than 5%, most preferably do not drop more than 2% of their original distance from the bottom of the container in which the inventive composition is present when they have returned to a quiescent state following manual shaking when measured after 72 hours, more preferably when measured after 5 days, still more preferably when measured after 10 days, yet more preferably after 14 days when left in a quiescent state at room temperature following the initial 48 hour period following manual shaking. In certain particularly preferred embodiments of the invention at least 90% of, preferably at least 95% and most preferably at least 97% of the inclusions physically present in the compositions do not drop more than 5%, after 3 weeks and especially after 4 weeks, and especially after 2 months, and particularly especially after 6 months when retained in a quiescent state at room temperature.

Although optional, the compositions according to the present invention may include one or more further detersive surfactants particularly those selected from amongst anionic, amphoteric and zwitterionic surfactants, particularly those which may provide a detersive effect to the compositions.

The compositions of the present invention may include at least an anionic surfactant. Generally any anionic surfactant material may be used in the inventive compositions. By way of non-limiting example, particularly suitable anionic surfactants include: alkali metal salts, ammonium salts, amine salts, or aminoalcohol salts of one or more of the following compounds (linear and secondary): alcohol sulfates and sulfonates, alcohol phosphates and phosphonates, alkyl sulfates, alkyl ether sulfates, sulfate esters of an alkylphenoxy polyoxyethylene ethanol, alkyl monoglyceride sulfates, alkyl sulfonates, olefin sulfonates, paraffin sulfonates, beta-alkoxy alkane sulfonates, alkylamidoether sulfates, alkylaryl polyether sulfates, monoglyceride sulfates, alkyl ether sulfonates, ethoxylated alkyl sulfonates, alkylaryl sulfonates, alkyl benzene sulfonates, alkylamide sulfonates, alkyl monoglyceride sulfonates, alkyl carboxylates, alkyl sulfoacetates, alkyl ether carboxylates, alkyl alkoxy carboxylates having 1 to 5 moles of ethylene oxide, alkyl sulfosuccinates, alkyl ether sulfosuccinates, alkylamide sulfosuccinates, alkyl sulfosuccinamates, octoxynol or nonoxynol phosphates, alkyl phosphates, alkyl ether phosphates, taurates, N-acyl taurates, fatty taurides, fatty acid amide polyoxyethylene sulfates, isethionates, acyl isethionates, and sarcosinates, acyl sarcosinates, or mixtures thereof. Generally, the alkyl or acyl radical in these various compounds comprise a carbon chain containing 12 to 20 carbon atoms.

Preferred anionic surfactants useful in forming the compositions of the invention include alkyl sulfates which may be represented by the following general formula:

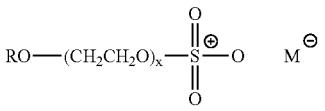

wherein R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Of these, most preferred are the non-ethoxylated C12–C15 primary and secondary alkyl sulfates.

Exemplary commercially available alkyl sulfates include one or more of those available under the tradenames RHODAPON® (ex. Rhône-Poulenc Co.) as well as STEPANOL® (ex. Stepan Chemical Co.). Exemplary alkyl sulfates which is preferred for use is a sodium lauryl sulfate surfactant presently commercially available as RHODAPON® LCP (ex. Rhône-Poulenc Co.), as well as a further sodium lauryl sulfate surfactant composition which is presently commercially available as STEPANOL® WA Extra (ex. Stepan Chemical Co.), which is amongst the most preferred anionic surfactants to be used in the inventive compositions. In certain preferred embodiments an alkyl sulfate is the sole anionic surfactant present.

Particularly preferred anionic surfactants useful in forming the compositions of the invention include alkyl sulfonate anionic surfactants which may be represented according to the following general formula:

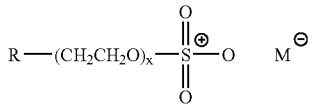

wherein R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Most preferred are the C12–C15 primary and secondary alkyl sulfates.

Exemplary, commercially available alkane sulfonate surfactants include one or more of those available under the tradename HOSTAPUR® (ex. Clariant). An exemplary and particularly alkane sulfonate which is preferred for use is a secondary sodium alkane sulfonate surfactant presently commercially available as HOSTAPUR® SAS 60.

The anionic surfactant when present in the compositions of the present invention is present in an amount of from about 0.1 to about 10% by weight, more preferably is present in an amount of from about 0.1–10% wt., and most preferably is present in an amount of from about 0.5 to about 4% wt.

For example the compositions according to the invention may optionally further comprise an alkyl ethoxylated carboxylate surfactant. In particular, the alkyl ethoxylated carboxylate comprises compounds and mixtures of compounds which may be represented by the formula:

$$R_1(OC_2H_4)_n—OCH_2COO^-M^+$$

wherein $R_1$ is a $C_4$–$C_{18}$ alkyl, n is from about 3 to about 20, and M is hydrogen, a solubilizing metal, preferably an alkali metal such as sodium or potassium, or ammonium or lower alkanolammonium, such as triethanolammonium, monoethanolammonium, or diisopropanolammonium. The lower alkanol of such alkanolammonium will normally be of 2 to 4 carbon atoms and is preferably ethanol. Preferably, R1 is a $C_{12}$–$C_{15}$ alkyl, n is from about 7 to about 13, and M is an alkali metal counterion.

Examples of alkyl ethoxylated carboxylates contemplated to be useful in the present invention include, but are not necessarily limited to, sodium buteth-3 carboxylate, sodium hexeth-4 carboxylate, sodium laureth-5 carboxylate, sodium laureth-6 carboxylate, sodium laureth-8 carboxylate, sodium laureth-11 carboxylate, sodium laureth-13 carboxylate, sodium trideceth-3 carboxylate, sodium trideceth-6 carboxylate, sodium trideceth-7 carboxylate, sodium trideceth-19 carboxylate, sodium capryleth-4 carboxylate, sodium capryleth-6 carboxylate, sodium capryleth-9 carboxylate, sodium capryleth-13 carboxylate, sodium ceteth-13 carboxylate, sodium $C_{12-15}$ pareth-6 carboxylate, sodium $C_{12-15}$ pareth-7 carboxylate, sodium $C_{14-15}$ pareth-8 carboxylate, isostearetb-6 carboxylate as well as the acid form. Sodium laureth-8 carboxylate, sodium laureth-13 carboxylate, pareth-25-7 carboxylic acid are preferred. A particularly preferred sodium laureth-13 carboxylate can be obtained from Finetex Inc. under the trade name Surfine® WLL or from Clariant Corp. under the trade name Sandopan® LS-24.

When present, the amount of alkyl ethoxylated carboxylate present in inventive compositions are from about 0.01% wt.–10% wt., preferably from about 0.1–10% wt. but most preferably from about 0.5–4% wt.

By way of non-limiting example exemplary amphoteric surfactants include one or more water-soluble betaine surfactants which may be represented by the general formula:

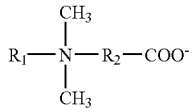

wherein: R1 is an alkyl group containing from 8 to 18 carbon atoms, or the amido radical which may be represented by the following general formula:

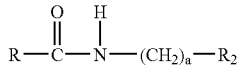

wherein R is an alkyl group having from 8 to 18 carbon atoms, a is an integer having a value of from 1 to 4 inclusive, and $R_2$ is a $C_1$–$C_4$ alkylene group. Examples of such water-soluble betaine surfactants include dodecyl dimethyl betaine, as well as cocoamidopropylbetaine.

When present, any amphoteric surfactants present in the compositions of the present invention are desirably included in an amount of from about 0.1 to about 10% by weight, more preferably is present in an amount of from about 0.3–5% wt., and most preferably is present in an amount of from about 0.3% wt. to about 3% wt.

Most desirably, the total amount of detersive surfactants present in the inventive compositions, inclusive of the necessary anionic surfactants and any further optional surfactants does not exceed about 10% wt., more preferably does not exceed about 5% wt. of the total weight of the inventive composition.

Optionally, but in many cases desirably, the inventive compositions comprise one or more organic solvents. By way of non-limiting example exemplary useful organic solvents which may be included in the inventive compositions include those which are at least partially water-miscible such as alcohols (e.g., low molecular weight alcohols, such as, for example, ethanol, propanol, isopropanol, and the like), glycols (such as, for example, ethylene glycol, propylene glycol, hexylene glycol, and the like), water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethylene glycol or propylene glycol (e.g. propylene glycol monomethyl ether acetate), and mixtures thereof. Glycol ethers having the general structure Ra—Rb—OH, wherein Ra is an alkoxy of 1 to 20 carbon atoms, or aryloxy of at least 6 carbon atoms, and Rb is an ether condensate of propylene glycol and/or ethylene glycol having from one to ten glycol monomer units. Of course, mixtures of two or more organic solvents may be used in the organic solvent constituent.

When present, the organic solvent constituent is present in the compositions of the present invention in an amount of from about 0.1 to about 10% by weight, more preferably is present in an amount of from about 0.3–7% wt., and most preferably is present in an amount of from about 0.5% wt. to about 4% wt. According to certain embodiments an organic solvent in necessarily present, as the presence of one or more organic solvents are useful in the cleaning of hydrophobic soils on hard surfaces.

According to certain particularly preferred embodiments, the inventive compositions exclude added organic solvents, particularly those described immediately above. While it is recognized that organic solvents may be present as carriers for certain other constituents essential to the present invention, and these may be present; generally the total amount of such organic solvents included in constituents provided from supplies, if present, is less than about than 0.1% wt., more preferably less than 0.05% wt. and most preferably comprise no organic solvents as described above. According to such certain particularly preferred embodiments, the inventive compositions include no organic solvents which are added other than those which may or may not be present in one or more of the constituents from the supplier thereof. According to certain especially particularly preferred embodiments, the inventive compositions include no organic solvents.

While optional, the compositions of the invention may further include an oxidizing agent, which is preferably a peroxyhydrate or other agent which releases hydrogen peroxide in aqueous solution. Such materials are per se, known to the art. Such peroxyhydrates are to be understood as to encompass hydrogen peroxide as well as any material or compound which in an aqueous composition yields hydrogen peroxide. Examples of such materials and compounds include without limitation: alkali metal peroxides including sodium peroxide and potassium peroxide, alkali perborate monohydrates, alkali metal perborate tetrahydrates, alkali metal persulfate, alkali metal percarbonates, alkali metal peroxyhydrate, alkali metal peroxydihydrates, and alkali metal carbonates especially where such alkali metals are sodium or potassium. Further useful are various peroxydihydrate, and organic peroxyhydrates such as urea peroxide. Desirably the oxidizing agent is hydrogen peroxide.

Desirably the oxidizing agent, especially the preferred hydrogen peroxide is present in the inventive compositions in an amount of from about 0.01% wt. to about 10.0% wt., based on the total weight of the composition of which it forms a part.

Minor amounts of stabilizers such as one or more organic phosphonates, stannates, pyrophosphates, as well as citric acid as well as citric acid salts may be included and are considered as part of the oxidizing agent. The inclusion of one or more such stabilizers aids in reducing the decomposition of the hydrogen peroxide due to the presence of metal ions and or adverse pH levels in the inventive compositions.

The compositions of the present invention can also optionally comprise one or more further constituents which are directed to improving the aesthetic or functional features of the inventive compositions. By way of non-limiting example such further constituents include one or more coloring agents, fragrances and fragrance solubilizers, viscosity modifying agents, other surfactants, pH adjusting agents and pH buffers including organic and inorganic salts, optical brighteners, opacifying agents, hydrotropes, anti-foaming agents, enzymes, anti-spotting agents, anti-oxidants, preservatives, and anti-corrosion agents. When one or more of the optional constituents is added, i.e., fragrance and/or coloring agents, the aesthetic and consumer appeal of the product is often favorably improved. The use and selection of these optional constituents is well known to those of ordinary skill in the art. When present, the total amount the one or more optional constituents present in the inventive compositions do not exceed about 10% wt., preferably do not exceed 5% wt., and most preferably do not exceed about 3% wt. Certain optional constituents which are nonetheless desirably present in the inventive compositions are pH adjusting agents and especially pH buffers. Such pH buffers include many materials which are known to the art and which are conventionally used in hard surface cleaning and/or hard surface disinfecting compositions. By way of non-limiting example pH adjusting agents include phosphorus containing compounds, monovalent and polyvalent salts such as of silicates, carbonates, and borates, certain acids and bases, tartrates and certain acetates. Further exemplary pH adjusting agents include mineral acids, basic compositions, and organic acids, which are typically required in only minor amounts. By way of further non-limiting example pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use as buffers such materials as aluminosilicates (zeolites), borates, aluminates and certain organic materials such as gluconates, succinates, maleates, and their alkali metal salts. When present, the pH adjusting agent, especially the pH buffers are present in an amount effective in order to maintain the pH of the inventive composition within a target pH range.

As the compositions are largely aqueous in nature, and comprises as the balance of the composition water in to order to provide to 100% by weight of the compositions of the invention. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the aqueous compositions according to the invention.

The inventive compositions provide certain technical benefits when used on hard surfaces, particularly: satisfactory removal of hard water stains, satisfactory removal of soap scum stains, and satisfactory disinfection or sanitization of hard surfaces. In preferred embodiments, the compositions are readily pumpable using a manually operable trigger spray apparatus are be desirably provided as a ready to use product in a container package which comprises a manually operable trigger spray apparatus and a non-pressurized reservoir or bottle for containing the inventive compositions. In use, the consumer generally applies an effective amount of the composition and within a few moments thereafter, wipes off the treated area with a rag, towel, brush or sponge, usually a disposable paper towel or sponge. In certain applications, however, especially where undesirable stain deposits are heavy, the composition according to the invention may be left on the stained area until it has effectively loosened the stain deposits after which it may then be wiped off, rinsed off, or otherwise removed. For particularly heavy deposits of such undesired stains, multiple applications may also be used.

The inventive compositions are desirably packaged in non-pressurized bottle which is supplied with a manually operable such as a manually pumpable trigger spray apparatus which is used to dispense the compositions from the bottle onto a surface.

A particularly advantageous feature of the inventive compositions is that as the suspended inclusions are visibly discrete and visibly discernible to the consumer, these same inclusions are visible to the consumer on hard surfaces to which the inventive compositions have been applied. This permits for ready visual inspection of the coverage of the hard surface by an inventive composition immediately after application of the composition by a consumer. Such provides not only an attractive attribute to commercial products based on such compositions but also provides a visual indicator to the consumer of thorough coverage and contact with hard surfaces. This visual indicator provides an important means whereby the consumer may visually inspect a surface, particularly a surface wherein the presence of undesired microorganisms is suspected, to ensure that thorough coverage and contact with said hard surface is realized. As is known, physical contact between the inventive composition and undesired microorganisms is required in order to the inventive compositions to provide a disinfecting effect.

An important technical characteristic lies in rheology of the inventive compositions. The compositions may be described as being rheopectic at lower shear rates, an especially upon standing in quiescent state, but are thixotropic at higher shear rates. Such dual properties are very advantageous, as when the compositions are at rest in a container, e.g., upon standing, their rheopectic behavior provides for the stable suspension of the inclusions described herein. When it is desired to dispense the compositions from a container especially through a manually operable trigger pump spray apparatus, the thixotropic characteristics of the compositions permit for their dispensing through the nozzle of such a pump spray apparatus. An exemplary manually operable trigger pump spray apparatus, such as a "Specialty Trigger Pump Spray/Off" (ex. Owens-Illinois Corp.). Ideally, after being dispensed from such a pump spray apparatus and onto a surface, especially an inclined surface the compositions return to a quiescent state and once again display a rheopectic behavior. Furthermore, as at least some of the suspended inclusions are delivered from the composition and onto the surface, these inclusions are present on the surface and provide a useful indicator as to the coverage of the sprayed composition onto the surface.

Alternatively in certain preferred embodiments the compositions of the invention may be provided in a conventional aerosol as well, and a propellant added to the constituents making up the composition. However the latter use of the inventive compositions in an aerosol dispenser is unlikely to be adopted for practical use as current conventional aerosol dispenser are typically metal canisters which do not readily permit for the consumer to enjoy the appearance of the visibly discernible, visibly discrete particulate materials as suspended inclusions when the compositions are in a quiescent state. Nonetheless, the use of compositions provided in aerosol canisters does provide the benefit of pressurized dispensing of the composition, and the composition applied to a hard surface does present the visibly discernible, visibly discrete particulate materials on a treated surface. Nonetheless, the use of a manually operable trigger pump spray apparatus with the inventive compositions is usually preferred.

The inventive compositions are desirably provided as a ready to use product which may be directly applied to a hard surface. By way of example, hard surfaces suitable for coating with the polymer include surfaces composed of refractory materials such as: glazed and unglazed tile, brick, porcelain, glazed ceramics, vitreous ceramics such as china; glass; metals; plastics, e.g. polyester, vinyl, fiberglass, Formica®, Corian®; and other hard surfaces known to the industry. Such known hard surfaces are usually non-porous. Hard surfaces which are to be particularly denoted are lavatory fixtures such as shower stalls, bathtubs and bathing appliances (racks, curtains, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces especially those which include refractory materials, plastics, and glass. Still further hard surfaces include those associated with medical facilities, e.g., hospitals, clinics as well as laboratories, e.g., medical testing laboratories.

The compositions according to the invention are easily produced by any of a number of known art techniques. Conveniently, a part of the water is supplied to a suitable mixing vessel further provided with a stirrer or agitator, and while stirring, the remaining constituents are added to the mixing vessel, including any final amount of water needed to provide to 100% wt. of the inventive composition. The order of addition is often not critical but preferably, under constant stirring, to a portion of the water is first added the thickener constituent, thereafter stirring is allowed to continue until the thickener constituent is homogenously distributed in the water. Preferably a homogenizer or other high shear mixing device is used however so to ensure the uniform mixing of the thickener constituent in the compositions taught herein. Subsequently the nonionic surfactant is added, then the organic solvent if present, then the anionic surfactant followed by the remaining constituents, including optional constituent. Thereafter, the suspended inclusions are introduced, desirably as an aqueous slurry containing the alginate based inclusions in an aqueous carrier, and finally the remaining quantity of water needed to provide 100% wt. of the composition. While the process may be practiced at room temperature (approx. 20° C.) it may be advantageous to heat the initial charge of water to an elevated temperature, e.g., even in excess of 90° C. to facilitate the incorporation of one or more of the constituents, particularly the thickener constituents into the water.

The following examples below illustrate exemplary formulations and preferred formulations of the inventive composition. It is to be understood that these examples are presented by means of illustration only and that further useful formulations fall within the scope of this invention and the claims may be readily produced by one skilled in the art and not deviate from the scope and spirit of the invention. Throughout this specification and in the accompanying claims, weight percents of any constituent are to be understood as the weight percent of the active portion of the referenced constituent, unless otherwise indicated.

EXAMPLES

Exemplary formulations illustrating certain preferred embodiments of the inventive compositions which include no added organic solvents are described in detail in Table 1A below. Further formulations illustrating further preferred embodiments of the inventive compositions which include added organic solvents are described in detail in Table 1B below. Each of the exemplary formulations were produced generally in accordance with the following protocol.

Into a suitably sized vessel, a measured amount of water was provided at a temperature of between about 5° C.–30° C. and under stirring using a laboratory scale homogenizer device, the thickener constituents were first added, and homogenization was permitted to continue for about 30–90 minutes until the thickened mixture became homogenous. The thickened mixture was then removed from the homogenizer device and introduced into a laboratory beaker provided a motor driven propeller as a stirrer. Thereafter under constant uniform stirring the remaining constituents were added in the following sequence: surfactants, organic solvent (when present), acid, caustic (sodium hydroxide) and then the remaining constituents, with the suspended inclusions, e.g., alginate beads in a slurry being added as the last constituent. Thereafter the remaining amount of water needed to provide 100% wt. of the composition. Mixing of the constituents in the laboratory beaker took from about 30–90 minutes, and the total time of mixing generally lasted from about 60 minutes to about 180 minutes. In each case, mixing was maintained until the particular composition appeared to be homogeneous, and the suspended inclusions well dispersed. The exemplary compositions were pourable, readily pumpable using a manually operable trigger spray apparatus and retained exceptionally well mixed characteristics (i.e., stable mixtures) upon standing. Notwithstanding the above preferred protocol, other sequences of mixing and orders of addition of the constituents may be practiced.

Examples of inventive formulations are shown in Tables 1A and 1B below (unless otherwise stated the components indicated are provided as "100% active") wherein the amounts of the named constituents are indicated in % w/w. Deionized water was added in "quantum sufficient" to provide the balance to 100 parts by weight of the compositions.

TABLE 1A

| | Ex. 1 | Ex. 2 | Ex. 3 | Ex. 4 | Ex. 5 | Ex. 6 | Ex. 7 | Ex. 8 |
|---|---|---|---|---|---|---|---|---|
| gellan gum | 0.05 | 0.05 | 0.05 | 0.05 | 0.05 | 0.05 | 0.05 | 0.05 |
| xanthan gum | 0.10 | 0.10 | 0.10 | 0.10 | 0.10 | 0.10 | 0.10 | 0.10 |

TABLE 1A-continued

| | Ex. 1 | Ex. 2 | Ex. 3 | Ex. 4 | Ex. 5 | Ex. 6 | Ex. 7 | Ex. 8 |
|---|---|---|---|---|---|---|---|---|
| linear primary $C_8$–$C_{10}$ alcohol ethoxylated, avg. 4.5 moles ethoxylation[a] | 1.0 | 1.0 | — | — | 1.0 | 1.0 | 1.0 | 1.0 |
| fatty alcohol ethoxylate[b] | — | — | 1.0 | — | — | — | — | — |
| linear alcohol alkoxylate[c] | — | — | — | 1.0 | — | — | — | — |
| sodium lauryl sulfate[d] | 2.75 | — | — | — | — | — | — | — |
| decyl (sulfophenoxy) benzenesulfonic acid, disodium salt[e] | — | 2.75 | — | — | — | — | — | — |
| 2-hydroxy-1,2,3-propanetricarbolic acid | 3.5 | 3.5 | 3.5 | 3.5 | 3.5 | 3.5 | — | — |
| hydroxyacetic acid | — | — | — | — | — | — | 3.5 | — |
| hydroxypropionic acid | — | — | — | — | — | — | — | 3.5 |
| caustic soda | 0.42 | 0.44 | 0.46 | 0.53 | 0.39 | 0.45 | 0.43 | 0.34 |
| fragrance | 0.20 | 0.20 | 0.20 | 0.20 | 0.20 | 0.20 | 0.20 | 0.20 |
| alginate beads | 0.41 | 0.41 | 0.41 | 0.41 | 0.41 | 0.41 | 0.41 | 0.41 |
| di water | q.s. | q.s. | q.s. | q.s. | q.s. | q.s. | q.s. | q.s. |
| pH | 3.15 | 3.14 | 3.12 | 3.28 | 3.20 | 3.09 | 3.09 | 3.10 |

TABLE 1B

| | Ex. 9 | Ex. 10 | Ex. 11 | Ex. 12 | Ex. 13 | Ex. 14 | Ex. 15 | Ex. 16 |
|---|---|---|---|---|---|---|---|---|
| gellan gum | 0.05 | 0.05 | 0.05 | 0.05 | 0.05 | 0.05 | 0.05 | 0.05 |
| xanthan gum | 0.05 | 0.05 | 0.05 | 0.05 | 0.05 | 0.05 | 0.05 | 0.05 |
| dipropylene glycol n-butyl ether | 1.0 | 1.0 | 1.0 | — | 3.0 | 3.0 | 3.0 | 3.0 |
| dipropylene glycol methyl ether | — | — | — | 2.0 | — | — | — | — |
| linear primary $C_9$–$C_{11}$ alcohol ethoxylated, avg. 6 moles ethoxylation | 1.0 | 1.0 | 1.0 | 1.0 | 1.0 | 1.0 | 1.0 | 1.0 |
| decyl (sulfophenoxy) benzenesulfonic acid, disodium salt | 5.0 | 3.0 | 5.0 | 1.0 | 1.0 | 1.0 | 1.0 | 1.0 |
| 2-hydroxy-1,2,3-propanetricarbolic acid | — | — | — | — | — | 3.5 | — | — |
| hydroxyacetic acid | 4.0 | — | — | — | — | — | — | 4.0 |
| hydroxypropionic acid | — | 4.0 | 4.0 | 4.0 | 6.0 | — | 4.0 | — |
| caustic soda | 0.5 | 0.5 | 0.5 | 0.5 | 0.5 | 0.6 | 0.54 | 0.60 |
| alginate beads-green | 0.06 | 0.06 | 0.06 | 0.03 | 0.03 | 0.03 | 0.03 | 0.03 |
| alginate beads-blue | 0.03 | 0.03 | 0.03 | 0.03 | 0.03 | 0.03 | 0.03 | 0.03 |
| alginate beads-red | 0.03 | 0.03 | 0.03 | 0.06 | 0.06 | 0.03 | 0.03 | 0.03 |
| alginate beads-purple | — | — | — | — | — | 0.03 | 0.03 | 0.03 |
| fragrance | 0.25 | 0.25 | 0.25 | 0.20 | 0.25 | 0.25 | 0.25 | 0.25 |
| colorant | 0.03 | 0.03 | 0.03 | 0.03 | 0.009 | 0.009 | 0.009 | 0.009 |
| di water | q.s. | q.s. | q.s. | q.s. | q.s. | q.s. | q.s. | q.s. |
| viscosity | ** | ** | ** | ** | ** | ** | | |
| pH | ** | ** | ** | ** | ** | ** | | |

**= indicates that the sample was not tested

The identity of the individual constituents indicated above on Tables 1A and 1B are listed on the following table:

TABLE 2

| | |
|---|---|
| gellan gum | Kelcogel AFT (100%) (ex. Kelco) |
| xanthan gum | Kelzan ASXT (100%) (ex. Kelco) |
| dipropylene glycol methyl ether | Dowanol ® DPM (100%) (ex. Dow Chem. Co.) |

TABLE 2-continued

| | |
|---|---|
| dipropylene glycol n-butyl ether | Dowanol ® DPnB (100%) (ex. Dow Chem. Co.) |
| linear primary $C_8$–$C_{10}$ alcohol ethoxylated, avg. 4.5 moles ethoxylation[a] | Alfonic 810-4.5 (100%) (ex. Sassol) |

TABLE 2-continued

| | |
|---|---|
| linear primary C9–C11 alcohol ethoxylated, avg. 6 moles ethoxylation | Tomadol 91-6 (100%) (ex. Tomah) |
| fatty alcohol ethoxylate[(b)] | Genapol 26-L-80 (100%) (ex. Clariant) |
| linear alcohol alkoxylate[(c)] | Plurafac SL-62 (100%) (ex. BASF) |
| sodium lauryl sulfate[(d)] | Stepanol WAC (30%) (ex. Stepan Co.) |
| decyl (sulfophenoxy) benzenesulfonic acid, disodium salt[(e)] | Hostapur SAS 60 (60%) (ex. Clariant) |
| 2-hyroxy-1,2,3-propanetricarbolic acid | citric acid (100%) (ex. ADM) |
| hydroxyacetic acid | glycolic acid (70%) (ex. DuPont) |
| hydroxypropionic acid | lactic acid (88%) |
| caustic soda | sodium hydroxide (25%) "rayon grade" |
| colorant | proprietary composition |
| fragrance | proprietary composition |
| alginate beads | an aqueous suspension of alginate beads in an aqueous carrier containing a 2% concentration of calcium chloride; the drained weight of the beads comprises 73% of the total weight of the aqueous suspension of alginate beads (ex. geniaLabs Biotechnologie, Germany) |
| alginate beads - green<br>alginate beads - blue<br>alginate beads - red<br>alginate beads - purple | an aqueous suspension of alginate beads in an aqueous carrier containing a 2% concentration of calcium chloride; the drained weight of the beads comprises 73% of the total weight of the aqueous suspension of alginate beads (ex. geniaLabs Biotechnologie, Germany), with various individual colors (green, blue, veel, purple) |
| di water | deionized water |

Certain of the compositions described on Tables 1A and 1B above were tested to evaluate certain technical characteristics of the compositions.

Evaluation of Viscosity:

The viscosity of certain of the compositions of Table 1A were evaluated utilizing using an LVTDV II Brookfield Viscometer, #1 spindle at 30 rpm and 25° C. The viscosity of certain of the exemplary compositions is reported in the following table:

TABLE 3

| Example formulation: | Viscosity |
|---|---|
| Ex. 1 | 143 cps |
| Ex. 2 | 86.8 cps |
| Ex. 3 | 91.2 cps |
| Ex. 4 | 84.8 cps |
| Ex. 5 | 98.2 cps |
| Ex. 6 | 88.2 cps |
| Ex. 7 | 95.9 cps |
| Ex. 8 | 88.2 cps |

All of the compositions of Table 1A, after being manually shaken and then allowed to return to a quiescent state by permitting them to stand on a laboratory bench tabletop at room temperature (approx. 20° C.) for 48 hours, exhibited the behavior that the majority of (at least 95% of) the alginate beads do not drop more than 5%, often not more than 2% of their original distance as measured from the bottom of the container in which the particular inventive composition was present for a period of at least 4 weeks when maintained in a quiescent state at room temperature.

The viscosity of certain of the compositions of Table 1B were evaluated utilizing using an LVTDV II Brookfield Viscometer, #2 spindle at 30 rpm and 25° C. The viscosity of certain of the exemplary compositions is reported on Table 4, following. Testing was performed at various time intervals following initial production of the test sample, under different storage temperatures, namely at "room temperature" (approx. 68° F. (20° C.), 40° F., 105° F. and 120° F.). The storage at higher temperatures was intended to simulate the effects of storage at normal conditions, i.e., room temperature for a period of 6 months or more which is the expected shelf life of a commercial product produced based on a tested formulation.

TABLE 4

| Storage temperature | Time interval | pH | Viscosity (cps) |
|---|---|---|---|
| | Example 15 | | |
| room temperature | as-mixed | 3.00 | 50.1 |
| | 24 hours | 3.01 | 49.6 |
| | 1 week | 3.12 | 49.3 |
| | 2 weeks | 3.07 | 49.1 |
| | 4 weeks | 3.09 | 48.1 |
| | 6 weeks | 3.08 | 48.1 |
| 40° F. | 1 week | 3.13 | 50.1 |
| | 2 weeks | 3.08 | 51.1 |
| | 4 weeks | 3.10 | 51.1 |
| | 6 weeks | 3.11 | 51.1 |
| 105° F. | 1 week | 3.10 | 49.1 |
| | 2 weeks | 3.05 | 49.1 |
| | 4 weeks | 3.07 | 48.1 |
| | 6 weeks | 3.06 | 48.1 |
| 120° F. | 1 week | 3.09 | 51.1 |
| | 2 weeks | 3.04 | 51.6 |
| | 4 weeks | 3.06 | 52.1 |
| | Example 16 | | |
| room temperature | as-mixed | 3.01 | 59.1 |
| | 24 hours | 3.02 | 58.1 |
| | 1 week | 3.04 | 58.1 |
| | 2 weeks | 3.05 | 57.1 |
| | 4 weeks | 3.07 | 55.1 |
| | 6 weeks | 3.06 | 54.1 |
| 40° F. | 1 week | 3.04 | 54.1 |
| | 2 weeks | 3.05 | 54.1 |
| | 4 weeks | 3.07 | 54.1 |
| | 6 weeks | 3.08 | 54.1 |
| 105° F. | 1 week | 3.05 | 53.6 |
| | 2 weeks | 3.06 | 53.1 |
| | 4 weeks | 3.08 | 53.1 |
| | 6 weeks | 3.10 | 53.1 |
| 120° F. | 1 week | 3.05 | 60.1 |
| | 2 weeks | 3.06 | 63.1 |
| | 4 weeks | 3.08 | 64.1 |

Following each of the viscosity and pH tests, the formulations were observed. In each instance, at least 95% of the inclusions did not drop more than 5%, of their original distance from the bottom of the container.

As is evident from the test results reported on Table 3, the representative composition according to the invention exhibited excellent storage stability characteristics even under elevated temperatures.

Evaluation of Sprayability:

A quantity of a sample composition was placed into the interior of a non-pressurized bottle to which was affixed a manually operable "Specialty Trigger Pump Spray/Off" (ex. Owens-Illinois Corp.) trigger spray device. A vertical glass panel was used with the device to evaluate the sprayability characteristics of a sample composition. At varying distances from as little as 4 inches to as far as 24 inches, a composition was dispensed from the trigger spray device which was held perpendicularly to the vertical glass panel. The delivery of the composition from the trigger spray device, and the wetting characteristics of the composition were observed and evaluated. To be considered a "pass" the composition need be dispensed in a generally uniform spray from the trigger spray device within the range of 4–24 inches, and especially at about 18 from the vertical glass panel, and to generally even wet out the surface and not form a preponderance of beads or droplets which clung to the vertical glass panel without dispersing after contact.

Each of the formulations according to the invention described on Tables 1A and 1B were considered to "pass" the spray test described above.

Evaluation of Efficacy against Soap Scum:

The efficacy of inventive compositions in removing soap scum from a hard surface was evaluated in accordance with CSMA Methods DCC-16 (May 1995) titled "Guidelines for Evaluating the Efficacy of Bathroom Cleaners—Part 2: Scrubber Test for Measuring the Removal of Lime Soap". This test is described generally as follows:

First, a "parent" soil is made, based on the following formulation:

| "Parent" soil | % w/w |
|---|---|
| bar soap | 3.90 |
| Shampoo | 0.35 |
| Clay | 0.06 |
| artificial sebum | 0.15 |
| hard water | 95.54 |

The parent soil was produced according to the following steps: First, the bar soap was shaved into a suitable beaker. Afterward the remaining constituents were added in the order given above and stirred with three-blade propeller mixer. Next, the contents of the beaker was heated to 45–50° C. and mixed until a smooth, lump-free suspension was achieved. This usually required about two hours with moderate agitation. Subsequently, the contents of the beaker were filtered through a Buchner funnel fitted with Whatman #1 filter paper or equivalent. The filtrate was then resuspended in clean, deionized water, using the same amount of water used to make the soil, and this was filtered again. The (re-filtered) filtrate was uniformly dried overnight at 45° C. to form a filter cake. Thereafter, the filter cake was pulverized and was suitable for immediate use, or may be stored in a sealed container for up to six months.

The test substrates (tiles) were prepared in the following manner: each tile was thoroughly washed (using a commercially available hand dishwashing detergent such as, Doveg) and scrubbed using a non-metallic scouring pad (such as a Chore Boy® Long Last scrubbing sponge). The washed tiles were then permitted to dry in an oven at 40.5° C. overnight, then withdrawn and allowed to cool to room temperature (approx. 20° C.) before being provided with the standardized "hard water" test soil. It is to be noted that for each test, new tiles were utilized, namely, the tiles were not reused. In preparation for supplying the tiles with an amount of the test soil, a test soil was prepared based on the following formulation:

| Test soil: | % w/w |
|---|---|
| "parent" soil | 4.50 |
| hard water | 9.0 |
| hydrochloric acid (0.1N ) | 0.77 |
| Acetone | 85.73 |

The test soil was produced according to the following steps: The constituents indicated were introduced into a clean beaker, with the acetone being added prior to the water, and the 'parent' soil being added last. The contents of the beaker were mixed using a standard three blade laboratory mixer until the contents formed a uniform mixture, and the color changed from white to gray. This typically required 20–40 minutes, during which time the beaker was covered as much as possible to avoid excessive solvent loss. Next, a suitable quantity of the contents of the test soil from the beaker was provided to an artist's airbrush while the beaker was swirled to ensure soil uniformity. (If testing required more than one day, a fresh amount of test soil was prepared daily and used for that day's testing.)

Soil was applied to a number of clean, dry tiles placed into rows and columns in preparation for depositing of the test soil. The airbrush was operated at 40 psi, and the test soil was sprayed to provide a visually uniform amount of soil onto the tiles. (Uniform soil suspension during application was maintained by continuous brush motion and/or swirling of test soil in the airbrush.) In this manner, approximately 0.10 g–0.15 g test soil were applied per tile.

The tiles were then allowed to air dry for approximately 30 minutes, during which time the a laboratory hotplate was preheated to approximately 320° C. Each tile was sequentially placed on the hotplate until the test soil began to melt, thereby "aging" the test soil. The melting of the test soil was observed carefully, and each tile was removed shortly before the soil began to coalesce into large droplets. This process was repeated for each tile, allowing the hotplate to recover to 320° C. between tiles. Subsequently each tile was permitted to cool for at least about 30 minutes.

To evaluate cleaning, a treated test tile was placed in a Gardner Apparatus and secured. A dry 10 cm by 7.6 cm sponge was first moistened with 100 g of tap water, and the excess wrung out from the sponge. The sponge was then fitted into a suitably sized holder in the Gardner Apparatus. A 4–5 gram aliquot of a test formulation was then deposited directly onto the soiled surface of a tile, and allowed to contact the tile for 15 seconds. Thereafter, the Gardner Apparatus was cycled for from 3–6 strokes. The tile was then rinsed with tap water, and dried with compressed air from an airbrush compressor. This test was repeated several times for each formulation, using new treated test tile for each evaluation.

The tested tiles were evaluated by either reflective means, i.e., using a Minolta Chromameter in order to determine the change in reflectance between an unsoiled, untreated tile which was used as a "control", and the reflectance of a soiled tile which was cleaned using a quantity of an inventive composition in accordance with the test protocol described above. According to the reflective means, the percentage of hard water soil removal was determined utilizing the following equation:

$$\% \text{ Removal} = \frac{RC - RS}{RO - RS} \times 100$$

where

RC=Reflectance of tile after cleaning with test product

RO=Reflectance of original soiled tile

RS=Reflectance of soiled tile

For each tile, a number of readings were taken and the results averaged to provide a median reading for each tile.

Five tiles were used to evaluate each of the tested compositions and the average reading for each tile, as well as the averaged reflectance reading for all five tiles treated using a particular composition described in Table 1A are reproduced below. These results may be compared to the reflectance of an unsoiled, untreated tile which exhibited an averaged reflectance of 93.3% which was used as a "control". The tested tiles were evaluated, and the results are indicated on the Table 4, below.

TABLE 5

| | Tile: | | | | | Averaged reflectance |
|---|---|---|---|---|---|---|
| | 1 | 2 | 3 | 4 | 5 | reading |
| Ex. 1 | 63.9% | 72.4% | 69.3% | 76.2% | 71.8% | 70.72% |
| Ex. 5 | 59.6% | 50.0% | 64.2% | 63.1% | 60.8% | 59.54% |
| Control: | 93.3% | — | — | — | — | 93.3% |

The cleaning efficacy of compositions described on Table 1B were also evaluated. For each tile, a number of readings were taken and the results averaged to provide a median reading for each tile. Six tiles were used to evaluate each of the tested compositions and the average reading for each tile, as well as the averaged reflectance reading for all five tiles treated using a particular composition described in Table 1B are reproduced below. The tested tiles were evaluated, and the results of the calculated "% removal" are indicated on the Table 6, below. Additionally two comparative formulations, of presently available commercial products "Fantastik" (ex. SC Johnson & Son) and "Formula 409" (ex. Clorox) used, as supplied in their trigger-spray bottles, were tested under identical conditions to provide a comparison as to the soil cleaning efficacy of the formulations according to the invention.

TABLE 6

| | Tile: | | | | | | |
|---|---|---|---|---|---|---|---|
| Formulation: | #1 | #2 | #3 | #4 | #5 | #6 | % Removal |
| Ex. 9 | 78.70 | 71.83 | 75.21 | 80.82 | 78.21 | 75.58 | 76.72 |
| Ex. 10 | 78.93 | 76.47 | 76.84 | 74.07 | 85.05 | 79.91 | 78.55 |
| Ex. 11 | 75.92 | 78.17 | 76.97 | 74.76 | 67.46 | 82.40 | 75.94 |
| Ex. 15 | 81.47 | 75.34 | 81.60 | 85.61 | 83.53 | 86.70 | 82.38 |
| Ex. 16 | 80.26 | 75.35 | 83.15 | 83.80 | 85.31 | 83.81 | 81.95 |
| Fantastik ® | 83.31 | 86.47 | 85.60 | 87.03 | 70.92 | 78.73 | 82.01 |
| Formula 409 ® | 72.26 | 82.12 | 85.92 | 86.22 | 82.45 | 67.54 | 79.42 |

As can be seen from the foregoing the compositions according to the invention provided good cleaning results similar to the commercial products.

Evaluation of Antimicrobial Efficacy:

Several of the exemplary formulations described in more detail on Table 1A above were evaluated in order to evaluate their antimicrobial efficacy against *Staphylococcus aureus* (gram positive type pathogenic bacteria) (ATCC 6538), *Salmonella choleraesuis* (gram negative type pathogenic bacteria) (ATCC 10708), *Pseudomonas aeruginosa* (ATCC 15442). The testing was performed in accordance with the protocols outlined in AOAC Official Method 961.02 "Germicidal Spray Products as Disinfectants", as described in AOAC Official Methods of Analysis, 16th Ed., (1995).

As is appreciated by the skilled practitioner in the art, the results of the AOAC Germicidal Spray Test indicates the number of test substrates wherein the tested organism remains viable after contact for 10 minutes with a test disinfecting composition/total number of tested substrates (slides) evaluated in accordance with the AOAC Germicidal Spray Test. Thus, a result of "0/15" indicates that of 15 test substrates bearing the test organism and contacted for 10 minutes in a test disinfecting composition, 0 test substrates had viable (live) test organisms at the conclusion of the test. Such a result is excellent, illustrating the excellent disinfecting efficacy of the tested composition.

Results of the testing are indicated on Table 7, below. The reported results indicate the number of test cylinders with live test organisms/number of test cylinders tested for each example formulation and organism tested.

TABLE 7

| | Test Results | Conclusion |
|---|---|---|
| *Staphylococcus aureus* | 0/15 | pass |
| *Salmonella choleraesuis* | 0/15 | pass |
| *Pseudomonas aeruginosa* | 0/15 | pass |

Similarly, aliquots of the formulation according to Example 15 described in more detail on Table 1B were evaluated in order to evaluate its antimicrobial efficacy against *Staphylococcus aureus* (gram positive type pathogenic bacteria) (ATCC 6538), *Salmonella choleraesuis* (gram negative type pathogenic bacteria) (ATCC 10708), *Pseudomonas aeruginosa* (ATCC 15442). The testing was performed in accordance with the same protocols outlined above for the samples whose results are reported on Table 7. The results for the evaluation of a formulation of Example 15 are indicated on the following Table 8.

TABLE 8

| | Test Results | Conclusion |
|---|---|---|
| *Staphylococcus aureus* | 0/10 | Pass |
| *Salmonella choleraesuis* | 0/10 | Pass |
| *Pseudomonas aeruginosa* | 0/10 | Pass |

As may be seen from the results indicated above, the compositions according to the invention provide excellent cleaning benefits to hard surfaces, including hard surfaces with difficult to remove stains. These advantages are further supplemented by the excellent antimicrobial efficacy of these compositions against known bacteria commonly found in bathroom, kitchen and other environments. Such advantages clearly illustrate the superior characteristics of the compositions, the cleaning and antimicrobial benefits attending its use which is not before known to the art.

The invention claimed is:

1. A sprayable hard surface cleaning and/or disinfecting composition which comprises:

a thickener constituent which comprises both gellan gum and xanthan gum;

at least one anionic surfactant;

at least one nonionic surfactant;

an acid constituent;

suspended inclusions which appear as visibly discernible, discrete particulate materials;

optionally, at least one further detersive surfactant selected from amphoteric and zwitterionic surfactants;

optionally, but desirably at least one organic solvent;

optionally, one or more constituents for improving the aesthetic or functional features of the inventive compositions; and;

water.

2. A composition according to claim 1 wherein the suspended inclusions are two or more classes of visibly discernible, discrete particulate materials.

3. A composition according to claim 1 wherein the suspended inclusions are three or more classes of visibly discernible, discrete particulate materials.

4. The composition according to claim 1 wherein the acid constituent contains an acid selected from the group consisting of: citric acid, sorbic acid, acetic acid, boric acid, formic acid, maleic acid, adipic acid, lactic acid, malic acid, malonic acid, glycolic acid, and mixtures thereof.

5. A composition according to claim 4 wherein the acid constituent comprises citric acid.

6. A composition according to claim 1 wherein the composition comprises an organic solvent.

7. A composition according to claim 6 wherein the organic solvent is selected from alcohols, glycols, water miscible ethers, water miscible glycol ethers, monoalkylether esters, and mixtures thereof.

8. A composition according to claim 7 wherein the organic solvent is selected from alcohols, water miscible glycol ethers and mixtures thereof.

9. A composition according to claim 1 wherein the compositions exclude added organic solvents.

10. A composition according to claim 1 wherein the majority of the inclusions do not drop more than 7% of their original distance as measured from the bottom of the container in which the inventive composition is present when they have returned to a quiescent state following manual shaking.

11. The composition according to claim 10 wherein the majority of the inclusions do not drop more than 7% of their original distance as measured from the bottom of the container in which the inventive composition is present when they have returned to a quiescent state following manual shaking when measured after 72 hours when left in a quiescent state at room temperature.

12. The composition according to claim 11 wherein the majority of the inclusions do not drop more than 7% of their original distance as measured from the bottom of the container in which the inventive composition is present when they have returned to a quiescent state following manual shaking when measured after 5 days when left in a quiescent state at room temperature.

13. The composition according to claim 12 wherein the majority of the inclusions do not drop more than 7% of their original distance as measured from the bottom of the container in which the inventive composition is present when they have returned to a quiescent state following manual shaking when measured after 10 days when left in a quiescent state at room temperature.

14. The composition according to claim 13 wherein the majority of the inclusions do not drop more than 7% of their original distance as measured from the bottom of the container in which the inventive composition is present when they have returned to a quiescent state following manual shaking when measured after 14 days when left in a quiescent state at room temperature.

15. The composition according to claim 1 wherein the pH is less than about than 6.

16. The composition according to claim 15 wherein the pH is from about 2 to about 3.5.

17. The composition according to claim 15 wherein the pH is from about 2.8 to about 3.3.

18. The composition according to claim 1 wherein the anionic surfactant is an alkane sulfonate.

19. The composition according to claim 1 wherein the anionic surfactant is a secondary sodium alkane sulfonate.

20. The composition according to claim 1 wherein the nonionic surfactant is a nonionic block copolymer based on a polymeric ethoxy/propoxy units.

21. The composition according to claim 1 wherein said composition exhibits antimicrobial efficacy against at least one of the following organisms: *Staphylococcus aureus* (gram positive type pathogenic bacteria) (ATCC 6538), *Salmonella choleraesuis* (gram negative type pathogenic bacteria) (ATCC 10708), *Escheria coli* (gram negative type pathogenic bacteria) (ATCC 11229) and *Pseudomonas aeruginosa* (ATCC 15442) according to the AOAC Use-Dilution Test Method.

22. A method of treating a hard surface comprising applying an effective amount of a composition according to claim 1 to a surface in need of treatment.

* * * * *